US007634932B2

(12) United States Patent
Cadiz et al.

(10) Patent No.: US 7,634,932 B2
(45) Date of Patent: Dec. 22, 2009

(54) FOB INTEGRATED KEY

(75) Inventors: Mariano Cadiz, Rochester, MI (US); James A. Willyard, Clarkston, MI (US); Timothy Lyon, Dearborn, MI (US); Steve Holmes, Plymouth, MI (US); Edward Pinardi, Clarkston, MI (US)

(73) Assignee: Chrysler Group LLC, Auburn Hills, MI (US)

( * ) Notice: Subject to any disclaimer, the term of this patent is extended or adjusted under 35 U.S.C. 154(b) by 0 days.

(21) Appl. No.: 11/565,765

(22) Filed: Dec. 1, 2006

(65) Prior Publication Data

US 2008/0127693 A1 Jun. 5, 2008

(51) Int. Cl.
*A44B 15/00* (2006.01)

(52) U.S. Cl. ..... 70/456 R; 70/459; 70/408

(58) Field of Classification Search ..... 70/408, 70/456 R, 459, 395, 336, 337, 388
See application file for complete search history.

(56) References Cited

U.S. PATENT DOCUMENTS

| | | | | |
|---|---|---|---|---|
| 6,097,106 | A | 8/2000 | Roddy et al. | |
| 6,386,007 | B1 | 5/2002 | Johnson et al. | |
| 6,460,386 | B1 * | 10/2002 | Watanuki et al. | 70/456 R |
| 6,518,882 | B2 | 2/2003 | Johnson et al. | |
| 6,668,608 | B1 | 12/2003 | Derman | |
| 6,705,141 | B1 * | 3/2004 | Jacob et al. | 70/408 |
| 6,765,311 | B1 * | 7/2004 | Labonde | 307/10.1 |
| 6,848,288 | B1 | 2/2005 | Derman | |
| 2006/0010944 | A1 * | 1/2006 | Balko et al. | 70/456 R |
| 2006/0185410 | A1 * | 8/2006 | Mastrodonato et al. | 70/456 R |
| 2007/0022794 | A1 * | 2/2007 | Maier-Hunke | 70/456 R |
| 2009/0000343 | A1 * | 1/2009 | Giacomin et al. | 70/456 R |

OTHER PUBLICATIONS http://www.edmunds.com/apps/vdpcontainers/do/vdp/articleId=116741/pageNumber=1, posted Sep. 12, 2006.

* cited by examiner

*Primary Examiner*—Carlos Lugo
*Assistant Examiner*—Kristina R Fulton
(74) *Attorney, Agent, or Firm*—Ralph E. Smith

(57) ABSTRACT

A key fob for a vehicle has a first end that is used as a key for insertion into a vehicle ignition receptacle and a second end that defines an opening for internal storage of a separate, removable key. While the key fob will remotely unlock the vehicle doors and start the vehicle engine when turned in the vehicle ignition, the removable key is an auxiliary, mechanical access key that may be used on door locks and interior storage compartments. The key fob will not unlock interior storage compartments and the removable key will not sustain operation of the vehicle engine.

6 Claims, 4 Drawing Sheets

FOB INTEGRATED KEY

FIELD OF THE INVENTION

The present invention relates to a removable vehicle access key that is storable within an electronic vehicle key fob.

BACKGROUND OF THE INVENTION

Modern vehicles may employ various methods for vehicle owners to gain entry to their vehicles and also to start their vehicles. One such method of gaining access to and starting a vehicle is by using an electronic key fob. Such electronic key fobs generally provide access to a vehicle when a user presses a button on the fob to unlock a door(s). Such fobs may also have a traditional metal key protruding from the fob which inserts into an ignition component that, when turned, starts a vehicle engine. While such electronic key fobs have proven satisfactory for their purposes, each is associated with its share of limitations.

One such limitation of current vehicle key systems occurs when a vehicle operator desires to use a valet to park his or her vehicle while at a restaurant. More specifically, the valet usually takes the key fob from the driver which not only permits the valet to start the car, but also provides the valet with access to the various interior compartments of the vehicle, such as a center console and glove compartment. Another limitation of current vehicle key systems is that while some vehicle manufacturers offer a valet key separate from the electronic key fob, a vehicle operator must remember that he or she wants to use valet parking and remember to bring the separate valet key. Still yet, actually finding a seldom used, separate valet key may be inconvenient, frustrating and time consuming for a vehicle operator.

A further limitation of current key systems is that when a key fob is provided to a valet, a vehicle operator's entire ring of keys, including house keys, is commonly provided to a valet, or time is spent removing such excess keys for a ring on the fob. This presents an opportunity for a valet to copy significant keys of the operator and is also a burden to the valet who must find a place for a bulky and heavy ring of keys. Finally, many electronic key fobs that are used by a valet have no hole or device by which to hang or store the key fob while in the valet's possession.

What is needed then is a device that does not suffer from the above limitations. This, in turn, will provide a device that: possesses a valet key yet limits access to vehicle interior compartments; permits a valet to quickly and easily handle just one key; permits a valet with a method to hang the valet key; is aesthetically pleasing, relatively lightweight, and appear as if only one fob or key is present when in fact more than one are present; provides a way for an operator to very quickly detach a single vehicle access and engine operation key from the balance of an owner's keys.

SUMMARY OF THE INVENTION

A key fob for a vehicle may be used to remotely unlock vehicle doors, access a vehicle interior, and finally start a vehicle engine when an end of the key fob is inserted into a vehicle ignition receptacle. Additionally, a separate, removable key is stored within the key fob through the opposite end of the key fob by inserting the removable key into a slot in the opposite end of the fob. The key fob may be used as a valet key because the key fob permits vehicle access and engine operation, but will not permit access to interior compartments. The removable key may be retained by the vehicle owner when the vehicle is in possession of a valet, since the removable key will unlock door locks and interior compartments; however, the removable key can not be used to sustain engine operation.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

Figure 1:
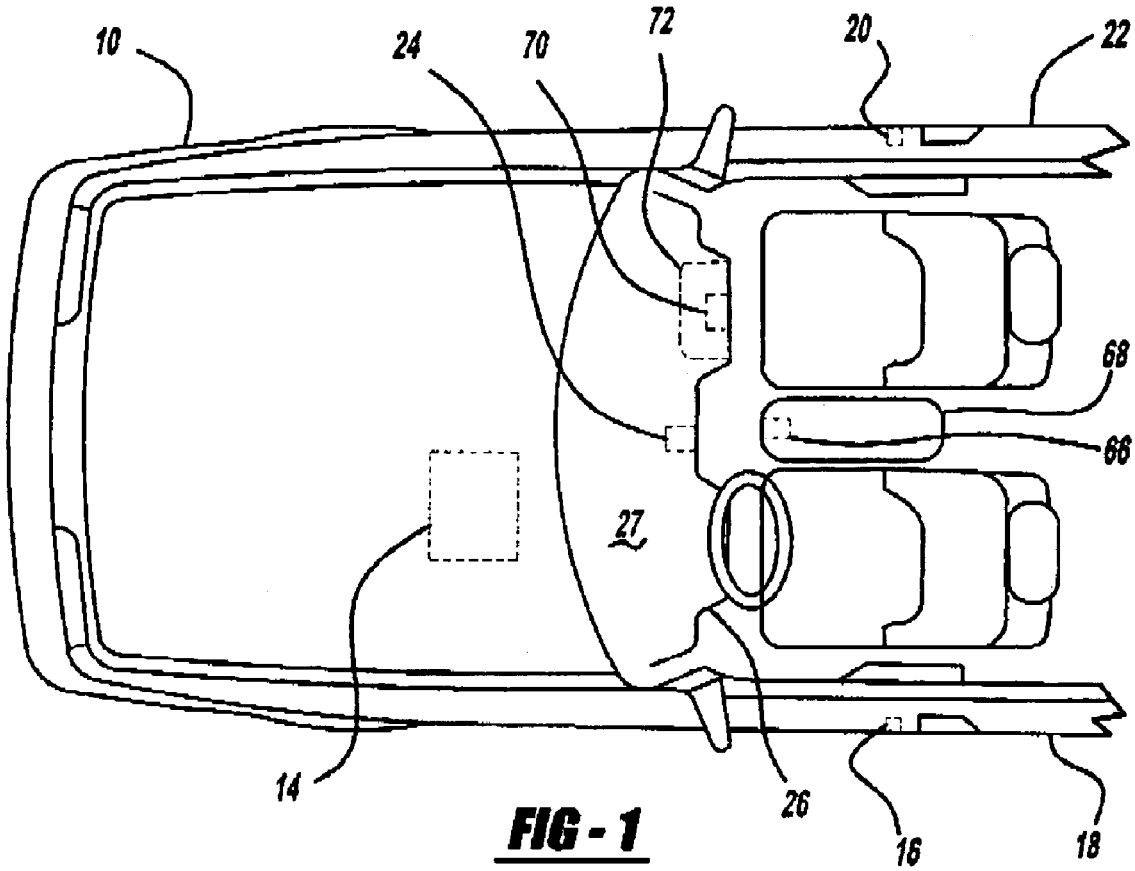
FIG. 1 is a top view of a vehicle that may be controlled by an integrated key fob according to the present invention.
Figure 2:
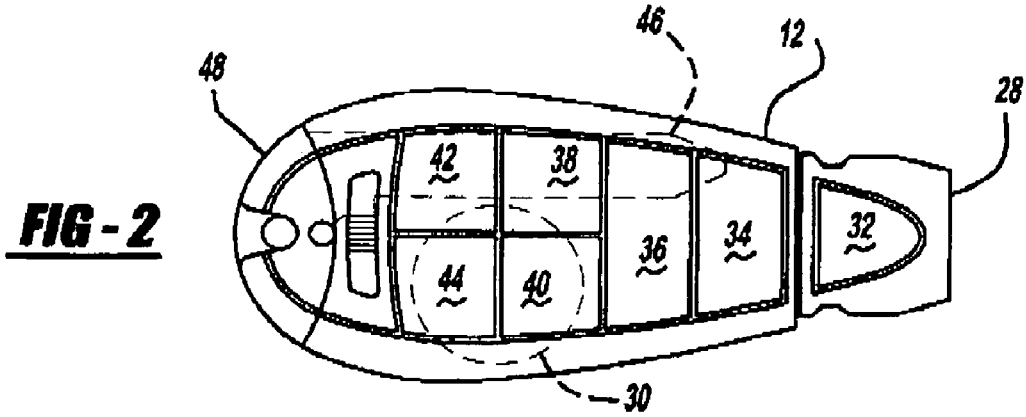
FIG. 2 is a top view of an integrated key fob depicting a location of a removable key according to the present invention.

FIG. 1 depicts a top view of a vehicle 10 that may be controlled by a fob integrated key 12 ("fobik") such as depicted in FIG. 2, according to the present invention. The fobik 12 may also be known casually as an electronic key fob, a key fob or simply as a fob. The fobik 12 may operate in conjunction with a control unit 14 to accomplish tasks such as unlocking a lock 16 on the driver side door 18 or a lock 20 on the passenger side door 22. The fobik 12 fits within a receptacle such as an ignition 24 on the steering column 26 or dash 27, as depicted in FIG. 1. More specifically, and with reference to FIG. 2, the end 29 of fobik 12 mates to the ignition 24.

Figure 3:
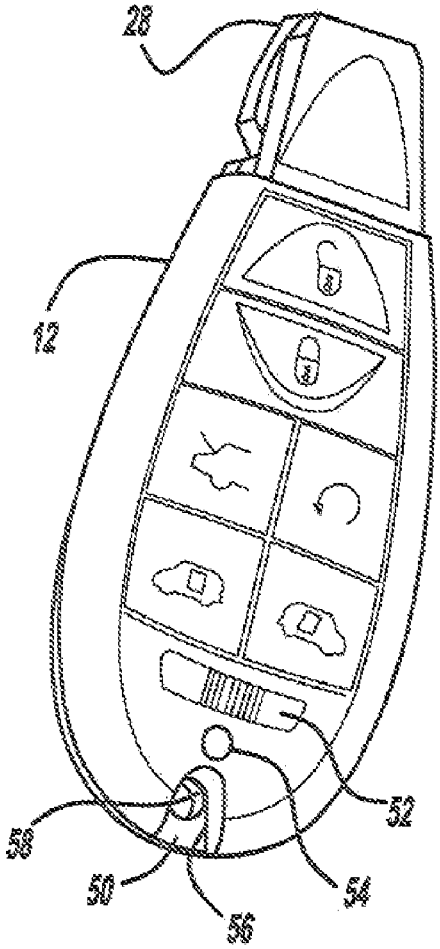
FIG. 3 is a perspective front view of an integrated key fob depicting exterior features according to the present invention.
Figure 4:
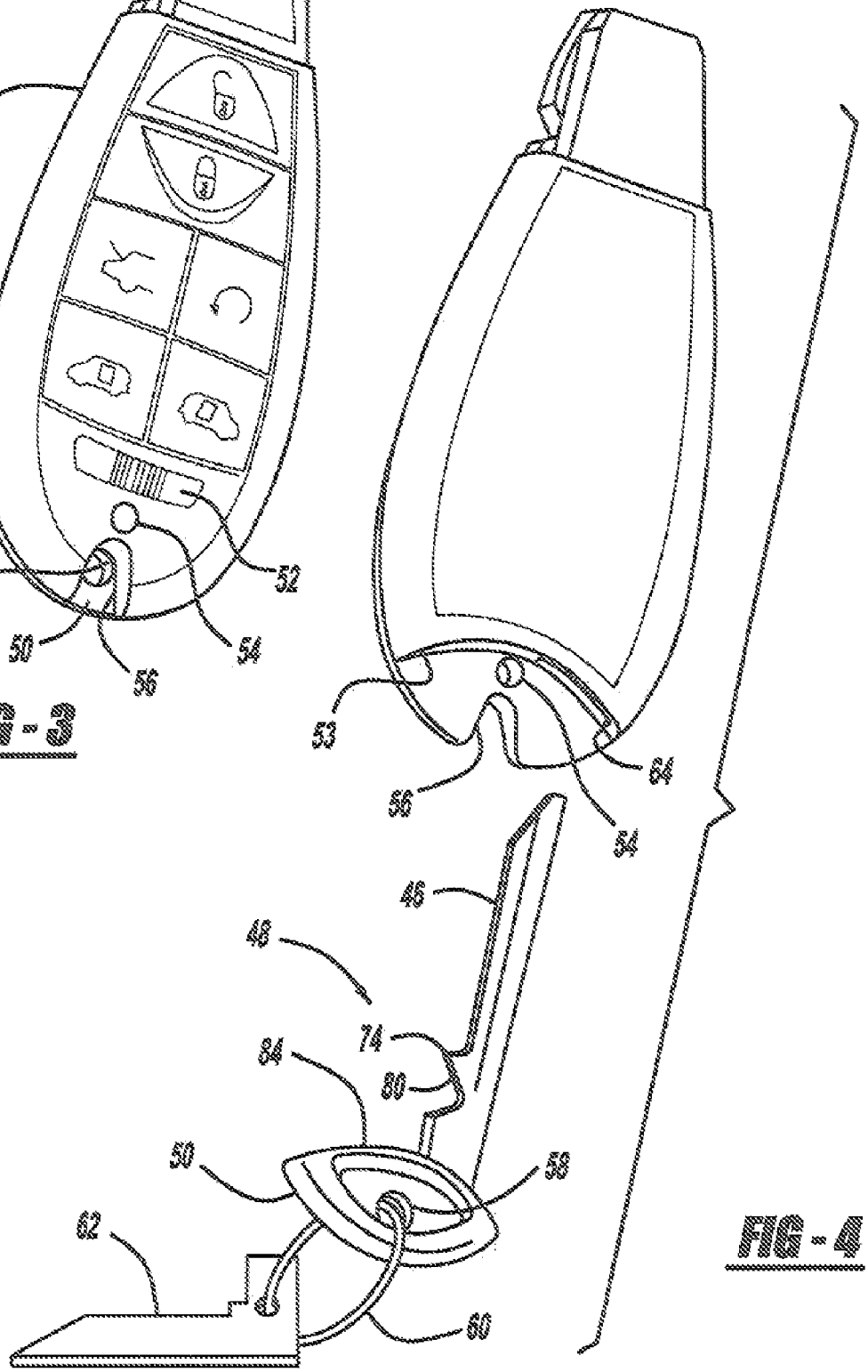
FIG. 4 is a perspective rear view of an integrated key fob and a removable key according to the present invention.
Figure 5:
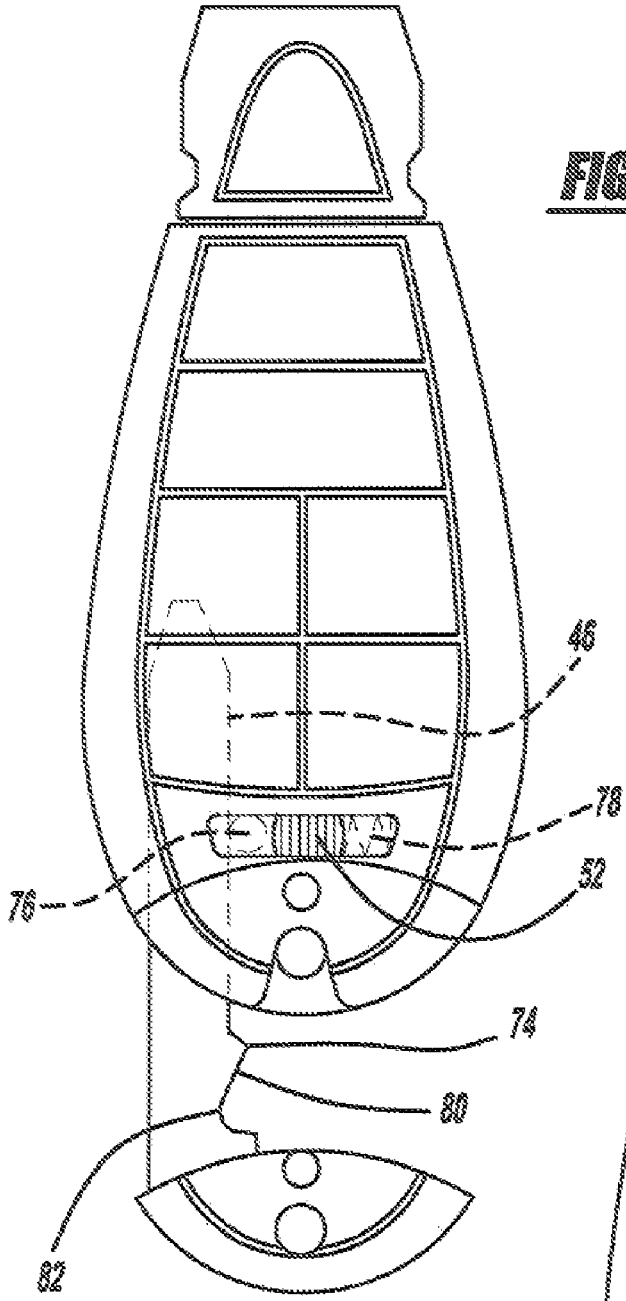
FIG. 5 is a top view of an integrated key fob depicting insertion steps of the removable key into the key fob.

Continuing with FIG. 2, the fobik 12 has an internal location for a battery 30 to provide power to the remote keyless ("RK") functions that may be controlled by pressing buttons 32-44 on the face of the fob 12. Examples of RK functions are panic 32, driver and passenger door unlock 34, driver and passenger door lock 36, rear trunk or lift gate unlock 38, left and right sliding door unlock 42, 44, and remote engine start 40. Adjacent to the battery 30 a key shank 46 slides into the fobik 12 from an end opposite to the end 29. The key shank 46 is part of a separate, removable key 48, also known as a mechanical key, that also has a key head 50 (FIG. 4). As depicted in FIGS. 2-4, the removable key 48 inserts into the fobik 12 such that the key head 50 resides within the fob recession 53 or cutout in the key fob 12 and such that the key head 50 smoothly conforms to or smoothly transitions with the overall contour of the fobik 12. With the key head 50 conforming to the overall contour or shape of the fobik 12, the fobik 12 not only retains its aesthetically pleasing appearance but also creates a full, seamless device that feels becoming in the palm of a user's hand.

FIGS. 3 and 4 also depict exterior features of the fobik 12. A fob hole 54 is present near the end of the fobik 12 to be used in conjunction with a nail or hook (not shown) so that the fobik 12 may be hung on a board, such as at a valet station or at home, etc. Adjacent to the fob hole 54 and also at the end of the fobik 12 is a fob slot 56. The fob slot 56 may be molded into the fobik 12 to provide a space for a traditional, mechanical key ring 60 that may be used to hold additional mechanical keys, such as key 62, as an example. Such additional mechanical keys may be used for entry into other buildings or areas for example by unlocking home door locks, office door locks, desk compartment locks, etc. Because the key ring 60 attaches through the key head hole 58 in the key head 50, the removable key 48 will be on the same key ring 60 as any additional key(s) 62.

Still yet another feature of the fobik 12 is that the fob itself is a key that inserts into the ignition 24 to start the engine of a vehicle 10. Stated another way, there is no metal key shank that protrudes from the fobik 12 at any time that is used to start the vehicle 10. Alternatively, the end 29 of the fob 12 is inserted into the ignition 24 to start the engine. The fobik 12 is made of a plastic that can sustain dropping and extended use without cracking, breaking, etc. Because the fobik 12 is molded from plastic, it is lightweight, relative to fobs with metal or heavy batteries, or non-detaching key rings, or permanent or flip-out metal key shanks.

A more detailed explanation of the operation of the fobik 12 and removable key 48 will now be explained. With the fobik 12, a vehicle operator (not shown) may approach a vehicle 10 and unlock a lock 16 of the driver side door 18 by pressing a button 34. The fobik 12 is able to communicate with a control unit 14, as an example, in the vehicle 10 to unlock the door 18 because the fobik 12 is equipped with a battery 30 to provide power. Upon entering the vehicle 10, the operator inserts the end 29 of the fobik 12 into the ignition 24, on the steering column 26 or dash 27, as examples. The electronic fobik 12 is verified as an authorized fob by an authorizing "handshake" between the fobik 12 and the control unit 14, as an example, after the fob end 29 is placed into the ignition 24 and the vehicle engine (not shown) starts. Without the correct authorization, the engine will stop after a short period of time; therefore, the authorizing handshake with the fobik 12 makes ongoing engine operation possible.

Continuing with use of the fobik 12, when the operator drives his vehicle to a valet stand at a restaurant, for example, that offers valet service, the operator may simply hold the fobik 12 and press laterally on the switch 52, which is parallel to the surface of fobik 12, to cause the switch 52 to move across the surface of the fobik 12. Upon movement of the switch 52, the removable key 48 easily slides from the hole 64 within which the removable key 48 resides. When the removable key 48 dislodges from the fobik 12, the key ring 60 and any additional personal key(s) 62 also separate from the fobik 12. The operator then retains the removable key 48 and any additional key(s) 62 and leaves the electronic fobik 12 with the valet. The valet must retain the fobik 12 because the electronic handshake between the fobik 12 and control unit 14 must occur for the engine to continue to operate; otherwise, the engine will cease to run.

The removable key 48 permits the operator to enter the vehicle mechanically by inserting the removable key 48 into the lock 16 or 20, as examples. Similarly, the removable key 48 permits the operator to open any exterior mechanical vehicle locks, such as a trunk lock (not shown). Additionally, the removable key 48 will permit the operator to lock and unlock interior compartments which include a console lock 66 in a center console 68 and a glove compartment lock 70 in a glove compartment 72. However, the removable key 48 by itself will not sustain operation of the vehicle engine because the removable key 48, being a mechanical key with no communication capabilities, cannot communicate or handshake with the control unit 14, as an example. Continuing with the valet scenario, the valet keeps the fobik 12 as the operator leaves with the removable key 48. With the fobik 12, the valet will be able to enter the vehicle by RKE, start the vehicle engine, and drive the vehicle yet will not be able to access areas such as the center console 68 or glove compartment 72. The center console 68 and glove compartment 72 can only be locked and unlocked with the mechanical, removable key 48.

Figure 6:
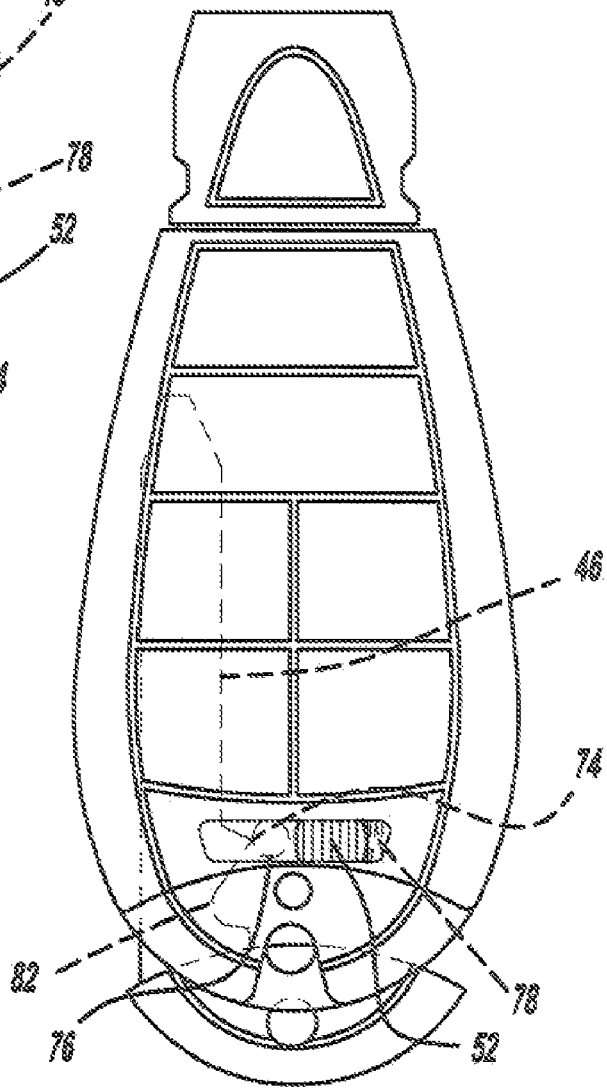
FIG. 6 is a top view of an integrated key fob depicting insertion of the key within the key fob.
Figure 7:
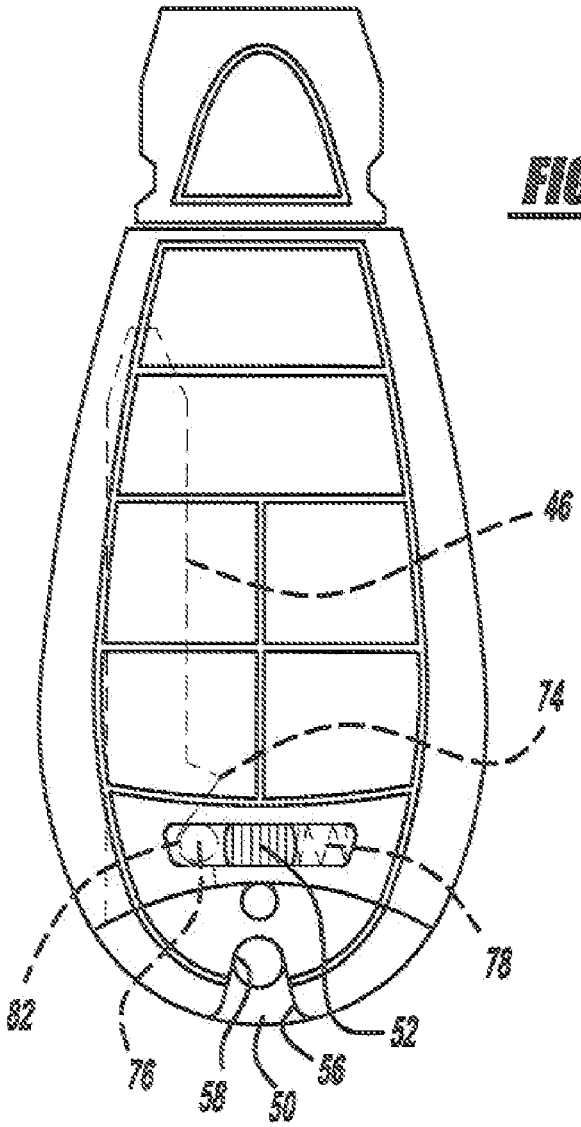
FIG. 7 is a top view of an integrated key fob depicting an internal key securely latched within the integrated key fob.

How the mechanical key 48 is secured into and retrieved from the fobik 12 will now be explained. With reference primarily to FIGS. 4-7, the key shank 46 is inserted into the hole 64 of the fobik 12. As the shank 46 proceeds into the hole 64, a tooth 74 protruding from the key shank 46 contacts a post 76 that is part of the mechanism of the release switch 52. As depicted in FIGS. 6 and 7, as the removable key 48 continues to be inserted, the post 76 is biased away from the key shank 46 by the tooth 74 until the tooth 74 passes the post 76. Upon further insertion, the tooth 74, which continually biases the spring 78 by its contact with the post 76, applies a force against the shank slope 80. As the shank 46 travels past the post 76, the post 76 will finally settle into a shank recession 82 at the base of the key shank 46. When the post 76 settles into the recession 82, the key head base 84 (FIG. 4) rests snugly within the fobik recession 53 such that a smooth appearance and nearly unnoticeable transition exists between the fobik 12 and key head 50 on the rear side of the fobik. With the spring 78 constantly providing force against the switch, which forces the post 76 into the recession 82, the removable key 48 is securely held in its fully inserted position. Even with the added weight of additional mechanical keys 62 on the key ring 60, the spring 78 is able to prevent the removable key 48 from withdrawing from the fobik 12.

Withdrawal of the removable key 48 from the fobik 12 is accomplished by pressing the release switch 52 parallel to the face of the fobik 12 to cause the switch 52 to increasingly bias against the internal spring 78 to permit the withdrawal of the post 76 from the recession 82. When the release switch 52 is biased against the spring 78 to an extent such that the post 76 will clear the lateral extremity of the tooth 74, the removable key 48 can then be withdrawn from the fobik 12 to separate the fobik 12 and the removable key 48.

There are numerous advantages to the teachings of the present invention. First, there is no protruding metal key shank from the fobik that is necessary to start an engine. To the contrary, the fobik 12 itself is insertable into an ignition 24. Furthermore, despite being a key itself, the fobik 12 retains its aesthetic appeal and smooth feel in the palm of a user's hand. Second, the fobik 12 has a second, removable key 48 that resides within the fobik itself. Because the second key resides within the fobik 12, a vehicle operator will never have to remember to take an extra key, such as a valet key, when the operator desires to valet his or her vehicle yet retain his own access to the vehicle. Third, when the vehicle is retained by a valet, the removable key 48 and any additional keys stay with the owner/operator. This means that the electronic fobik 12 only permits vehicle door access and engine starting; the electronic fobik 12 can not be used to access glove compartment or console locks, which are both unlockable with the removable, mechanical key. Additionally, the removable key 48 permits the operator to access all areas of the vehicle if he or she desires to return to the vehicle and access any door or compartment; the electronic fobik 12 is not necessary.

Fourth, because the electronic fobik 12 is all that is necessary to operate the vehicle, and it may be made of lightweight plastic, the metal removable key 48 may be removed and only the lightweight fobik 12 need be carried by a driver. This is especially useful when, for example, the operator is wearing clothing that is not particularly conductive to carrying heavy keys, such as a sweat suit or running shorts. Fifth, because the removable key 48 will not permit a vehicle engine to run for a prolonged period of time, say more than 10 seconds, the removable key may be given to a person to permit access to the vehicle without giving the person the ability to drive the vehicle, as would otherwise be possible with the electronic fobik 12.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A key fob for a vehicle, the key fob comprising:

a removable key, wherein the key fob at a first fob end includes a front surface and a rear surface, the rear surface includes a recession extending across an entire width of the fob and defines a receptacle where the removable key resides such that an end surface of the removable key directly engages the recession and forms a non-protruding flush fit with the first fob end upon stowage of the removable key in the receptacle and the end surface of the removable key defines a hole such that the hole is surrounded by the end surface, wherein the hole secures a key ring for keys, the hole and part of the key ring residing within a fob perimeter when the removable key is slidably inserted and stowed in the receptacle; the key fob further defining a slot open through the first fob end wherein the slot extends substantially perpendicular to the recession, wherein the key ring passes through the hole and the slot;

a switch, wherein the switch is operable to release the removable key such that after release the removable key can be slidably removed from the key fob receptacle; and a second fob end configured for insertion into a vehicle ignition receptacle, the removable key and hole residing completely within a fob perimeter upon stowage of the removable key within the receptacle.

2. The key fob of claim 1, wherein the switch further comprises a post and a spring and wherein the removable key further comprises a shank recession, the spring arranged to bias the post into the shank recession to secure the removable key within the key receptacle.

3. The key fob of claim 2, wherein the switch is operable to bias the spring away from the shank recession thus releasing the post from the shank recession and allowing the removable key to be removed from the receptacle.

4. A key fob for a vehicle, the key fob comprising:

a first fob end configured for insertion into a vehicle ignition receptacle;

a second fob end comprising a front surface and a rear surface, the rear surface having a recession extending across an entire width of the fob and defining a key receptacle and a separate slot that opens through the second fob end; wherein the slot extends substantially perpendicular to the recession;

a removable key having an end surface defining a hole such that the hole is surrounded by the end surface, wherein the hole secures a key ring that passes into the slot when the slot and the hole align during and after slidable insertion of the removable key in the key receptacle, wherein the removable key end surface directly engages the recession and forms a flush, non-protruding fit with the second fob end; and a switch, wherein the switch is used to release the removable key from the fob.

5. A key fob for a vehicle, the key fob comprising:

a first fob end configured for insertion into a vehicle ignition receptacle;

a second fob end comprising a front surface and a rear surface, the rear surface having a recession extending across an entire width of the fob and defining a key receptacle and a separate slot open through the recessed second fob end; wherein the slot extends substantially perpendicular to the recession;

a removable key, wherein the removable key has an end surface that further defines a hole such that the hole is surrounded by the end surface, the hole retains a key ring such that the slot and the hole align to permit passage of the key ring into the slot from an end of the second fob end when the removable key is slidably inserted into the key receptacle, and wherein the removable key end surface directly engages the recession and resides flush and non-protruding with the key fob during stowage of the removable key within the key receptacle; and a switch, wherein the switch is used to release the removable key from the fob.

6. The key fob of claim 5, the fob further comprising:

a post; and the removable key further comprising:

a shank recession, wherein the post biases into the shank recession to secure the removable key within the key receptacle.

* * * * *